US008246399B2

(12) United States Patent
Inaba

(10) Patent No.: US 8,246,399 B2
(45) Date of Patent: Aug. 21, 2012

(54) OUTBOARD MARINE MOTOR THAT ALLOWS A LARGE STEERING ANGLE

(75) Inventor: Takeshi Inaba, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 478 days.

(21) Appl. No.: 12/557,077

(22) Filed: Sep. 10, 2009

(65) Prior Publication Data

US 2010/0173543 A1 Jul. 8, 2010

(30) Foreign Application Priority Data

Jan. 6, 2009 (JP) ..... 2009-000893

(51) Int. Cl.

| | |
|---|---|
| ***B63H 5/125*** | (2006.01) |
| ***B63H 20/08*** | (2006.01) |
| ***B63H 20/12*** | (2006.01) |
| ***B63H 25/00*** | (2006.01) |
| ***B63H 25/42*** | (2006.01) |

(52) U.S. Cl. ..... 440/53; 440/58; 440/59

(58) Field of Classification Search ..... 440/53, 440/58–60, 61 R–61 C, 62, 63

See application file for complete search history.

(56) References Cited

U.S. PATENT DOCUMENTS

| | | | | |
|---|---|---|---|---|
| 2,688,299 | A * | 9/1954 | Gload et al. | 440/58 |
| 2,900,947 | A * | 8/1959 | Cotal | 440/58 |
| 3,310,021 | A * | 3/1967 | Shimanckas | 440/86 |
| 3,799,102 | A * | 3/1974 | Smith | 440/60 |
| 4,371,348 | A * | 2/1983 | Blanchard | 440/52 |
| 4,373,920 | A * | 2/1983 | Hall et al. | 440/59 |
| 4,887,982 | A * | 12/1989 | Newman et al. | 440/81 |
| 5,224,888 | A * | 7/1993 | Fujimoto et al. | 440/61 R |
| 7,485,018 | B2 * | 2/2009 | Wilson et al. | 440/59 |

* cited by examiner

*Primary Examiner* — Ajay Vasudeva
(74) *Attorney, Agent, or Firm* — Rankin, Hill & Clark LLP

(57) ABSTRACT

In an outboard marine motor including an upper case (4) enclosing an engine (E) and a lower case (5) fitted with a propeller (12) and connected to a lower end of the upper case, the lower case is configured to be turned relative to the upper case around a vertical axial line which is coaxial with a vertical drive shaft (10) that transmit torque of the engine to the propeller. Thereby, the outboard marine motor can be steered simply by turning the lower case. Because the upper case having a relatively large lateral dimension as compared with the lower case is not required to be turned, a large steering angle can be achieved without the outboard marine motor interfering with watercraft having the outboard marine motor mounted thereon. In particular, the lower case is turned by an actuator including an electric motor and a worm gear mechanism (50) for transmitting an output torque of the electric motor to the lower case so that a high speed reduction ratio can be achieved by using a highly compact structure.

20 Claims, 3 Drawing Sheets

OUTBOARD MARINE MOTOR THAT ALLOWS A LARGE STEERING ANGLE

TECHNICAL FIELD

The present invention relates to an outboard marine motor, and in particular an outboard marine motor that is highly compact and can provide a large steering angle.

BACKGROUND OF THE INVENTION

An outboard marine motor typically includes an internal combustion engine, a propeller which is powered by the engine and produces a propelling force, and a skeg formed in a lower part thereof to afford directional stability. The outboard marine motor is typically attached to a transom board of a boat via a mounting fixture which includes a vertical hinge shaft so that the outboard marine motor can be pivoted around the hinge shaft in either direction. The pivoting movement of the outboard marine motor causes the direction of the propeller and skeg to be changed accordingly, and this provides a steering action of the boat.

Therefore, the steering action of the boat requires an upper part of the outboard marine motor to be turned in a corresponding manner. The upper part of the marine motor is enlarged, in particular in the lateral dimension thereof, as compared with a lower part thereof because the engine is placed in the upper part thereof. Therefore, to ensure a large steering angle, there is a need to avoid any interference between the outboard marine motor and adjoining part of the boat.

It is proposed in Japanese patent laid open publication No. 63-97489 to place the engine inside the boat and a propulsion system including a propeller outside the boat. It allows the propulsion system to be turned around the pivot shaft to a desired angle without difficulty, but the engine limits the available space of the boat. This is not acceptable particularly in small boats.

When the outboard marine motor is steered, a significant force is required to maintain the steering angle owing to the resistance of water applied to the skeg and other parts of the outboard marine motor. This creates a need for a relatively large power actuator.

Japanese patent laid open publication 2006-264523 discloses an outboard marine motor that is incorporated with a hydraulic actuator to steer the outboard marine motor. This allows the outboard marine motor to be steered without any manual effort, and simplifies the remote control arrangement for steering the outboard marine motor, but has the disadvantage that the hydraulic actuator must be placed in a part of the boat on which the outboard marine motor is mounted. This is not desirable in small boats that have limited available space. Also, this complicates the structure of the mounting fixture that is used to mount the outboard marine motor on the boat.

BRIEF SUMMARY OF THE INVENTION

In view of such problems of the prior art, a primary object of the present invention is to provide an outboard marine motor that allows a large steering angle without causing any interference between the outboard marine motor and watercraft having the outboard marine motor mounted thereon.

A second object of the present invention is to provide an outboard marine motor that allows a large steering angle without restricting an internal space of watercraft having the outboard marine motor mounted thereon.

A third object of the present invention is to provide an outboard marine motor that can reduce an effort required to steer the outboard marine motor.

A fourth object of the present invention is to provide an outboard marine motor that is enabled to steer the outboard marine motor by using a highly compact structure.

According to the present invention, such an object can be accomplished by providing an outboard marine motor, comprising: an upper case receiving an internal combustion engine therein; a mounting fixture configured to attach the upper case to a part of watercraft; a lower case connected to a lower end of the upper case so as to be rotatable relative to the upper case around a first vertical axial line; a propeller shaft extending in the lower case in a fore-and-aft direction; a propeller attached to a rear end of the propeller shaft projecting from a rear end of the lower case; a drive shaft extending vertically at least in the lower case coaxially with the first vertical axial line, and having an upper end connected to an output shaft of the engine in a torque transmitting relationship; a torque transmitting mechanism interposed between a lower end of the drive shaft and the propeller shaft; and an actuator provided in the upper case and configured to selectively turn the lower case around the first vertical axial line, the actuator including a power source and a worm gear mechanism for transmitting an output torque of the power source to the lower case.

Because the steering action of the outboard marine motor can be effected by turning only the lower part of thereof, interference with the surrounding part of the boat can be minimized, and this maximizes the maximum steering angle of the outboard marine motor. This is particularly advantageous when two or more outboard marine motors are used one next to the other. In particular, because the actuator is incorporated with a worm gear mechanism, a high speed reduction ratio can be achieved by using a highly compact structure. Additionally, the reaction from the lower case that may include a skeg owing to water resistance can be prevented from being transmitted to the electric motor, and this eliminates any need to produce a force that is required to maintain a steering angle.

In an outboard marine motor, the drive shaft extends into the lower case, and the rotation of the lower case relative to the upper casing around a vertical shaft is possible only around the axial line of the drive shaft. This can be accomplished if the lower case is connected to the upper case via a tubular member defining a hollow interior so as to receive the drive shaft therein, the tubular member having a lower end attached to the lower case and an upper end projecting into the upper case and rotatably supported by a bearing secured to the upper case.

The steering of the lower case can be effected manually by using a remote control arrangement, but it is more advantageous if the actuator includes a power actuator such as an electric motor attached to the upper case for actuating the tubular member.

According to a preferred embodiment of the present invention, a worm wheel is provided around the tubular member and the electric motor is provided with an output shaft, either mechanically or functionally, fitted with a worm that meshes with the worm wheel. The worm may be attached either directly to the output shaft or via an assembly for transmitting torque.

According to a particularly preferred embodiment of the present invention, the electric motor has an axial line extending in parallel with the first vertical axial line, and the worm gear mechanism further includes an intermediate shaft rotatably supported by the upper case, a driven bevel gear attached to a first end of the intermediate shaft, and a drive bevel gear attached to the output shaft of the electric motor and meshing with the driven bevel gear, the worm being attached to a second end of the intermediate shaft.

Thereby, the electric motor can be disposed in such a manner that the cross sectional area of the part of the upper case which is normally submerged in water can be minimized. It is equally important that this vertical orientation of the electric motor ensures a favorable aerofoil shape of the cross section.

The intermediate shaft may extend substantially horizontally and at a small angle with respect to a fore-and-aft direction so that the most common teeth configuration may be used, and the worm gear mechanism may be most conveniently confined in a favorable aerofoil shaped cross section of the upper case. Alternatively, the intermediate shaft may be inclined with respect to the horizontal direction by suitably selecting the teeth configuration of the worm gear mechanism so that the electric motor may be placed at a higher or lower elevation. This may allow more convenient positioning of the electric motor.

The torque of the drive shaft must be transmitted to the propeller shaft while the lower case is allowed to rotate around the vertical axial line with respect to the upper case. This can be accomplished by an arrangement where the torque transmitting mechanism includes a pinion bevel gear provided at the lower end of the drive shaft, a forward bevel gear and a reverse bevel gear rotatably mounted on the propeller shaft and meshing with the pinion bevel gear, and a clutch unit for selectively engaging one of the forward bevel gear and reverse bevel gear with the propeller shaft.

If the mounting fixture includes a swivel shaft that supports the upper case so as to be rotatable around a second vertical axial line which is different from and parallel to the first axial line, it is possible to combine the steering angle achieved by the rotation of the upper case around the swivel shaft relative to the watercraft with the steering angle achieved by the rotation of the lower case relative to the upper case around the drive shaft. Thereby, the total steering angle can be maximized.

Typically, the upper case comprises an engine cover covering the engine and an extension case attached to a lower end of the engine cover and covering an engine mount supporting the engine.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 1:
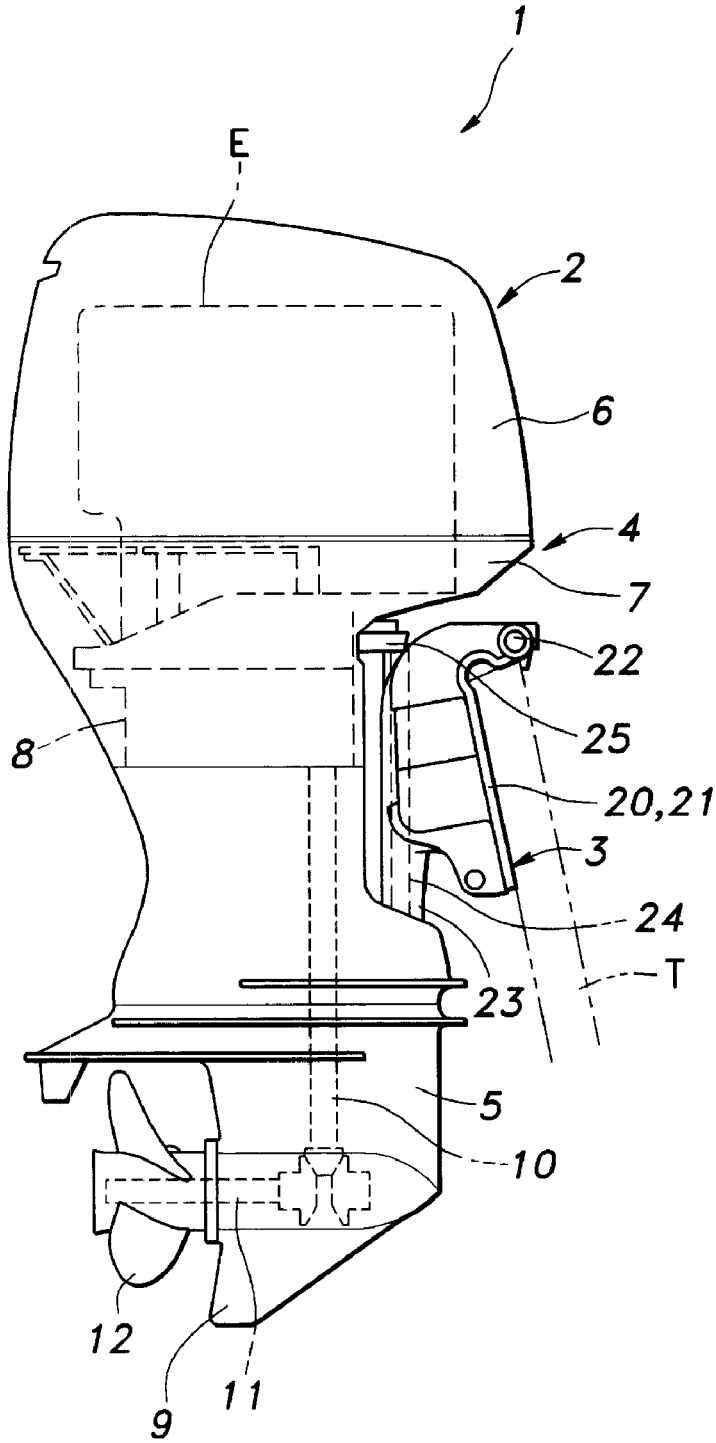
FIG. 1 is a side view of an outboard marine motor embodying the present invention.

Referring to FIG. 1, an outboard marine motor 1 embodying the present invention comprises a motor main body 2 and a mounting fixture 3 that mounts the motor main body 2 to a transom board T of watercraft such as a boat.

The mounting fixture 3 includes a pair of brackets 20 and 21 fixedly attached to the transom board T in a laterally spaced relationship, a tilt pin 22 extending between the two brackets 20 and 21 and a swivel case 23 mounted on the tilt pin 22 so as to be tilted with respect to the brackets 20 and 21. Therefore, when the boat is moored, the motor main body 2 can be tilted upward out of the water around the tilt pin 22 to protect the outboard marine motor 1 from corrosion.

The swivel case 23 defines a cylindrical hollow interior 23*a* having a vertically extending axial line (second vertical axial line). A vertically extending swivel shaft 24 is fixedly attached to the motor main body 2 via a pair of mount frames 25 extending forward from the front side of the motor main body 2. The swivel shaft 24 is received in the hollow interior 23*a* of the swivel case 23 so that the motor main body 2 can be swung laterally around the swivel shaft 24, but is normally fixed at a neutral position by a mechanical or other fixing means not shown in the drawing. The lateral swinging movement of the motor main body 2 can be effected either manually by using a tiller handle, preferably that can be retracted when not in use or by using a power actuator.

The motor main body 2 includes an upper case 4 and a gear case (lower case) 5 which are separate from each other. The upper case 4 includes an engine cover 6 that receives an internal combustion engine E and an extension case 7 that is connected to the lower end of the engine cover 6 and receives an engine mount 8 supporting the engine E. The engine E is provided with a vertically extending crankshaft in the illustrated embodiment.

A propeller 12 is provided at a rear end of the gear case 7, and a skeg 9 depends from the bottom end of the gear case 7. A lower part of the gear case 7 is normally submerged in water when the outboard marine motor 1 is in use. The gear case 5 is rotatable relative to the upper case 4 around a vertical axial line (first vertical axial line) as will be described hereinafter, and the interface between the upper case 4 and gear case 5 is sealed against intrusion of water into the gear case 5.

Figure 2:
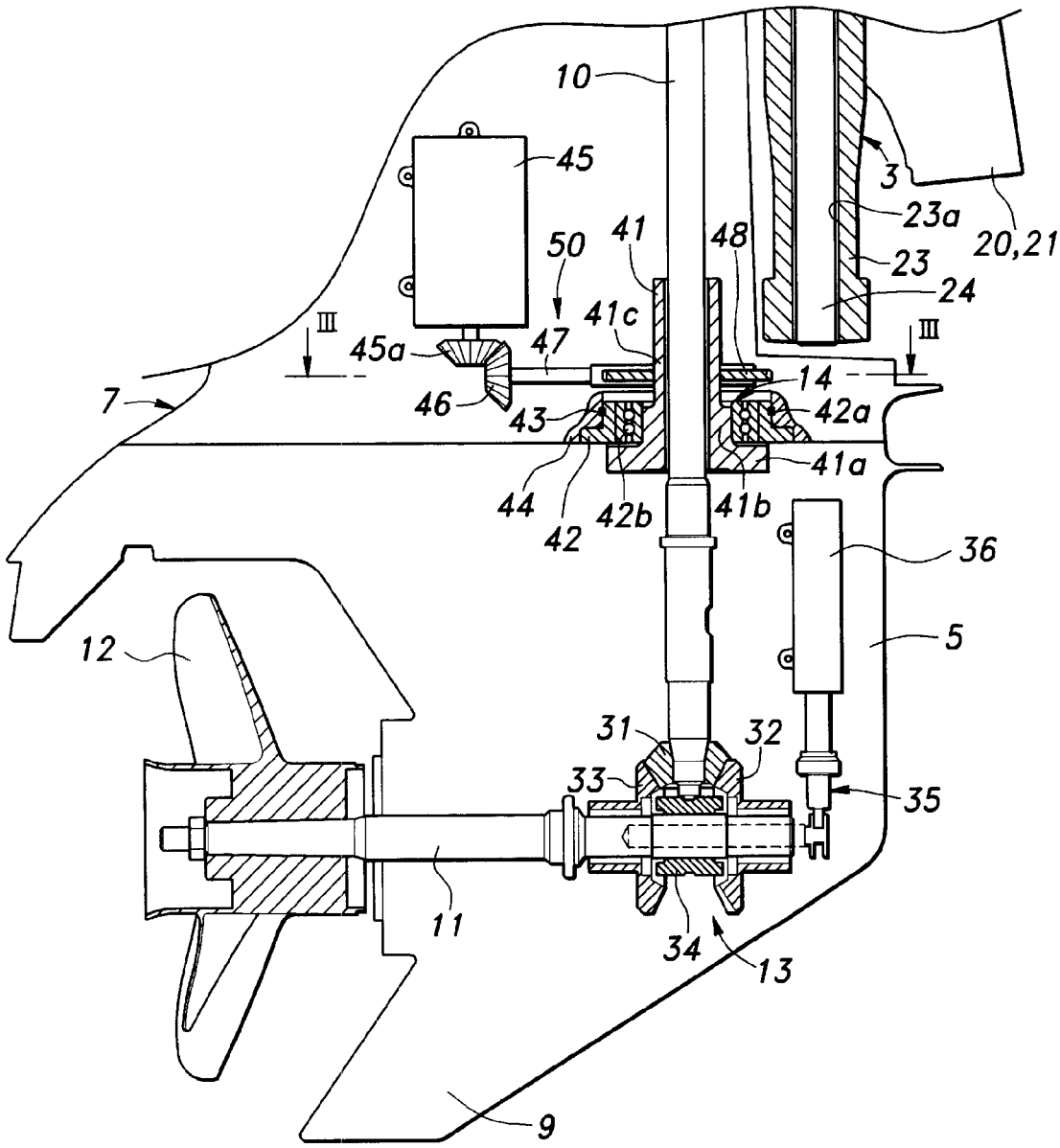
FIG. 2 is a fragmentary cross sectional side view of a preferred embodiment of the present invention.

As shown in FIG. 2, a drive shaft 10 extends vertically in the extension case 7, and is rotatably supported by a bearing not shown in the drawing. An upper end of the drive shaft 10 is connected to the crankshaft of the engine E in a torque transmitting relationship. A lower end of the drive shaft 10 extends into the gear case 5, and is fitted with a bevel pinion gear 31.

A propeller shaft 11 extends substantially horizontally in the gear case 5, and is rotatably supported by a bearing not shown in the drawings. The propeller 12 is attached to the rear end of the propeller shaft 11 that projects rearward from the gear case 5. A torque transmitting mechanism 13 is interposed between a lower end of the drive shaft 10 and a front end of the propeller shaft 13. A shift mechanism 35 that cooperates with the torque transmitting mechanism 13 is provided in the rearmost end of the propeller shaft 11.

The torque transmitting mechanism 13 transmits the power of the engine from the drive shaft 10 to the propeller shaft 12, and comprises a bevel pinion gear 31 attached to the lower end of the drive shaft 10, a forward bevel gear 32 and reverse bevel gear 33 rotatably mounted on the propeller shaft 11 so as to mesh with the bevel pinion gear 31 and a clutch member 34 that selectively engages the propeller shaft 11 with a selected one of the forward bevel gear 32 and reverse bevel gear 33. Therefore, the forward bevel gear 32 and reverse bevel gear 33 rotate in mutually opposite directions as the bevel pinion gear 31 turns, and one of the forward bevel gear 32 and reverse bevel gear 33 is connected to the propeller shaft 11 via the clutch member 11.

The clutch member 34 is configured to be actuated by a shift mechanism 35 which is powered by an electric motor 36. The shift mechanism 35 and electric motor 36 are placed in the gear case 5. When the clutch member 34 engages the forward bevel gear 32 with the propeller shaft 11, the propeller 12 turns in the direction to drive the boat in the forward direction. When the clutch 34 engages the reverse bevel gear 33 with the propeller shaft 11, the propeller 12 turns in the direction to drive the boat in the backward direction.

The gear case 5 is connected to the extension case 7 via a connecting mechanism 14 that allows the gear case 5 to turn in either direction around a central axial line of the drive shaft 10. The connecting mechanism 14 includes a tubular member 41 which is integrally attached to the gear case 5 at a lower end thereof in a coaxial relationship to the drive shaft 10, and is provided with an upper end extending into the upper case 4 (extension case 7) and a bearing unit 42 which rotatably supports and axially retains the upper end of the tubular member 41.

The lower end of the tubular member 41 is formed with a radial flange 41*a* having an enlarged outer diameter. The radial flange 41*a* is attached to the gear case 5 via threaded bolts not show in the drawings. A thick walled portion 41*b* of the tubular member 41 adjacent to the radial flange 41*a* extends into the extension case 7, and is fitted into the bearing unit 42. A worm wheel 48 is coaxially attached to an upper end 41*c* of the tubular member 41.

The bearing unit 42 is incorporated with a radial ball bearing 42*b* which includes an inner race supporting the thick walled portion 41*b* of the tubular member 41 and an outer race fixedly attached to the extension case 7 via threaded bolts or the like. Therefore, the tubular member 41, along with the gear case 5, can rotate around the central axial line of the drive shaft 10 with respect to the extension case 7. The outer periphery of the bearing unit 42 may be formed with an annular groove 42*a* receiving an O-ring 43 therein that ensures a water-tight seal in cooperation with a retainer 44 made of plastic material and covering the outer periphery of the bearing unit 42.

An electric motor 45 is fixedly secured to the inner wall of the extension case 7 with a central axial line thereof extending in parallel with the central axial line of the drive shaft 10, and is provided with an output shaft that also extends in parallel with the central axial line of the drive shaft 10. Output torque of the electric motor 45 is transmitted to the tubular member 41 via a worm gear mechanism 50. The output shaft is provided with a drive bevel gear 45*a*.

Figure 3:
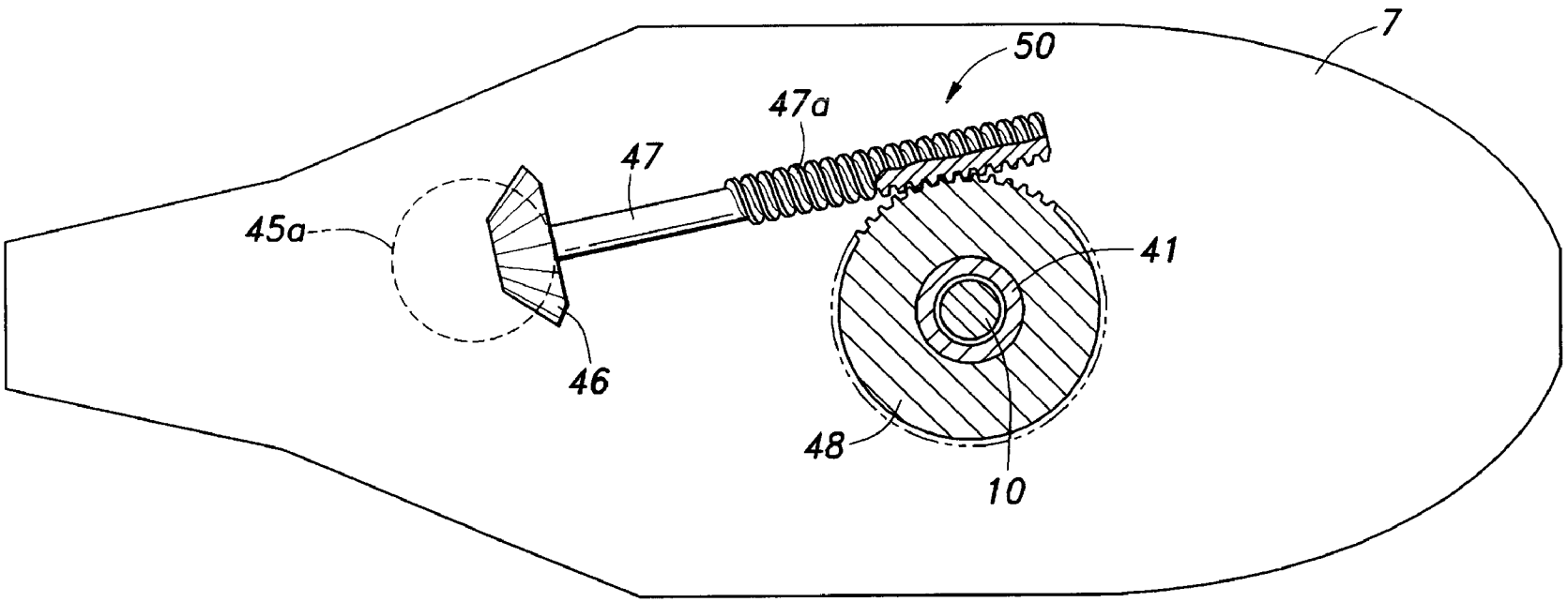
FIG. 3 is a cross sectional view taken along line of FIG. 2.

As shown in FIG. 3, the worm gear mechanism 50 includes an intermediate shaft 47 extending substantially horizontally and rotatably supported by the extension case 7. One end of the intermediate shaft 47 is fitted with a driven bevel gear 46 that meshes with the drive bevel gear 45*a*. A worm wheel 48 is fitted on an upper portion 41*c* of the tubular member 41. The other end of the intermediate shaft 47 is fitted with worm 47*a* that meshes with the worm wheel 48. The output shaft of the electric motor is provided in a laterally middle part of the extension case or slightly offset in either lateral direction, and the intermediate shaft extends at a small angle relatively to a central fore-and-aft axial line in the illustrated embodiment.

Alternatively, the intermediate shaft may be inclined with respect to the horizontal direction by suitably selecting the teeth configuration of the worm gear mechanism so that the electric motor may be placed at a higher or lower elevation. This may allow more convenient positioning of the electric motor.

Thereby, as the electric motor 45 is actuated in either direction, the tubular member 41 along with the gear case 5 is turned in the corresponding direction around the drive shaft 10. This changes the orientation of the propeller 12 and skeg 9 so that the propeller 12 provides a propelling force containing a component that steers the boat in the corresponding direction while the skeg 9 provides a fluid dynamic action that assists the steering movement of the boat. This rotational movement of the gear case 5 relative to the extension case 7 does not affect the meshing of the pinion bevel gear 31 with the forward and reverse bevel gears 32 and 33 as the rotational center of the pinion bevel gear 31 coincides with the rotational center line of the gear case 5.

As can be appreciated from the foregoing description, by activating the electric motor 45 in either direction, the gear case 5 is turned in the corresponding direction, and this provides a steering action to the boat. Therefore, the boat can be steered without moving the upper bulkier part of the outboard marine motor. This is particularly advantageous when two or more outboard marine motors are mounted on a transom board of a boat one next to the other. Also, the steering angle of the outboard marine motor can be increased because the problem of interference between the outboard marine motor is minimized. If desired, the actuator for turning the gear case relative to the upper case may be incorporated in the gear case.

Because the turning movement of the gear case 5 relative to the upper case 4 provides a steering action, it is possible to eliminate the need for the swivel action of the mounting fixture for the outboard marine motor, and this simplifies the structure of the mounting fixture. It is also possible to have the mounting fixture include an arrangement for swiveling action so that the outboard marine motor may be steered, be it only by a small steering angle, when the actuator for turning the gear case 5 should fail or when no power is available for the actuator for turning the gear case 5. As yet another option of the present invention, the steering of the gear case relative to the upper case and the steering of the upper case relative to the boat may be combined so that the total steering angle may be maximized.

In the illustrated embodiment, the shift mechanism 35 was actuated by using the electric motor 36, and this requires a wire harness that extends from the upper case 4 to the gear case 5, and is configured to tolerate and withstand the movement of the gear case 5 relative to the upper case 4. If desired, a push-pull cable, a torsion cable or other mechanical means for transmitting an actuating force for the clutch mechanism 35 to be transmitted from the boat or upper part of the outboard marine motor may also be used.

The steering of the gear case 5 was effected by the electric motor 45 in the illustrated embodiment, but it is also possible to use various other power sources such as hydraulic and pneumatic actuators. If desired, the gear case 5 may be steered manually by using a suitable mechanical remote control arrangement.

At any event, the use of a worm gear mechanism enables a high speed reduction ratio to be achieved by using a highly compact structure. Additionally, because the worm gear mechanism is an irreversible mechanism that transmits force only in one direction (provided that the lead angle of the work is properly selected), the reaction from the lower case that may include a skeg owing to water resistance can be prevented from being transmitted to the electric motor, and this eliminates any need to produce a force that is required to maintain a steering angle.

Although the present invention has been described in terms of a preferred embodiment thereof, it is obvious to a person skilled in the art that various alterations and modifications are possible without departing from the scope of the present invention which is set forth in the appended claims.

The contents of the original Japanese patent application on which the Paris Convention priority claim is made for the present application are incorporated in this application by reference.

The invention claimed is:

1. An outboard marine motor, comprising:

an upper case receiving an internal combustion engine therein;

a lower case connected to a lower end of the upper case so as to be rotatable relative to the upper case around a first vertical axial line;

a mounting fixture configured to attach the upper case to a part of a watercraft, wherein the mounting fixture includes a swivel shaft that supports the upper case so as to be rotatable around a second vertical axial line which is different from and parallel to the first axial line;

a propeller shaft extending in the lower case in a fore-and-aft direction;

a propeller attached to a rear end of the propeller shaft projecting from a rear end of the lower case;

a drive shaft extending vertically at least in the lower case coaxially with the first vertical axial line, and having an upper end connected to an output shaft of the engine in a torque transmitting relationship;

a torque transmitting mechanism interposed between a lower end of the drive shaft and the propeller shaft; and an actuator provided in the upper case and configured to selectively turn the lower case around the first vertical axial line, the actuator including a power source and a worm gear mechanism for transmitting an output torque of the power source to the lower case.

2. The outboard marine motor according to claim 1, wherein the lower case is connected to the upper case via a tubular member defining a hollow interior so as to receive the drive shaft therein, the tubular member having a lower end attached to the lower case and an upper end projecting into the upper case and rotatably supported by a bearing secured to the upper case.

3. The outboard marine motor according to claim 2, wherein the power source is an electric motor that is attached to the upper case for actuating the tubular member.

4. The outboard marine motor according to claim 3, wherein a worm wheel is provided around the tubular member and the electric motor drives an intermediate shaft that is fitted with a worm that meshes with the worm wheel.

5. The outboard marine motor according to claim 4, wherein the electric motor is provided in a part of the upper case behind the drive shaft.

6. The outboard marine motor according to claim 5, wherein the electric motor has an axial line extending in parallel with the first vertical axial line, and the worm gear mechanism further includes the intermediate shaft that is rotatably supported by the upper case, a driven bevel gear attached to a first end of the intermediate shaft, and a drive bevel gear attached to the output shaft of the electric motor and meshing with the driven bevel gear, the worm being attached to a second end of the intermediate shaft.

7. The outboard marine motor according to claim 6, wherein the intermediate shaft extends substantially horizontally and at a small angle with respect to a fore-and-aft direction.

8. The outboard marine motor according to claim 1, wherein the torque transmitting mechanism includes a pinion bevel gear provided at the lower end of the drive shaft, a forward bevel gear and a reverse bevel gear rotatably mounted on the propeller shaft and meshing with the pinion bevel gear, and a clutch unit for selectively engaging one of the forward bevel gear and reverse bevel gear with the propeller shaft.

9. The outboard marine motor according to claim 1, wherein the upper case comprises an engine cover covering the engine and an extension case attached to a lower end of the engine cover and covering an engine mount supporting the engine.

10. An outboard marine motor, comprising:

an upper case receiving an internal combustion engine therein;

a lower case connected to a lower end of the upper case so as to be rotatable relative to the upper case around a first vertical axial line;

a propeller shaft extending in the lower case in a fore-and-aft direction;

a propeller attached to a rear end of the propeller shaft projecting from a rear end of the lower case;

a drive shaft extending vertically at least in the lower case coaxially with the first vertical axial line, and having an upper end connected to an output shaft of the engine in a torque transmitting relationship;

a torque transmitting mechanism interposed between a lower end of the drive shaft and the propeller shaft, wherein the torque transmitting mechanism includes a pinion bevel gear provided at the lower end of the drive shaft, a forward bevel gear and a reverse bevel gear rotatably mounted on the propeller shaft and meshing with the pinion bevel gear, and a clutch unit for selectively engaging one of the forward bevel gear and reverse bevel gear with the propeller shaft; and an actuator provided in the upper case and configured to selectively turn the lower case around the first vertical axial line, the actuator including a power source and a worm gear mechanism for transmitting an output torque of the power source to the lower case.

11. The outboard marine motor according to claim 10, wherein the lower case is connected to the upper case via a tubular member defining a hollow interior so as to receive the drive shaft therein, the tubular member having a lower end attached to the lower case and an upper end projecting into the upper case and rotatably supported by a bearing secured to the upper case.

12. The outboard marine motor according to claim 11, wherein the power source is an electric motor that is attached to the upper case for actuating the tubular member.

13. The outboard marine motor according to claim 12, wherein a worm wheel is provided around the tubular member and the electric motor drives an intermediate shaft that is fitted with a worm that meshes with the worm wheel.

14. The outboard marine motor according to claim 13, wherein the electric motor is provided in a part of the upper case behind the drive shaft.

15. The outboard marine motor according to claim 14, wherein the electric motor has an axial line extending in parallel with the first vertical axial line, and the worm gear mechanism further includes the intermediate shaft that is rotatably supported by the upper case, a driven bevel gear attached to a first end of the intermediate shaft, and a drive bevel gear attached to the output shaft of the electric motor and meshing with the driven bevel gear, the worm being attached to a second end of the intermediate shaft.

16. The outboard marine motor according to claim 15, wherein the intermediate shaft extends substantially horizontally and at a small angle with respect to a fore-and-aft direction.

17. The outboard marine motor according to claim 10, wherein the upper case comprises an engine cover covering the engine and an extension case attached to a lower end of the engine cover and covering an engine mount supporting the engine.

18. An outboard marine motor, comprising:

an upper case receiving an internal combustion engine therein;

a lower case connected to a lower end of the upper case via a tubular member so as to be rotatable relative to the upper case around a first vertical axial line;

a worm wheel provided around the tubular member;

a propeller shaft extending in the lower case in a fore-and-aft direction;

a propeller attached to a rear end of the propeller shaft projecting from a rear end of the lower case;

a drive shaft extending vertically at least in the lower case coaxially with the first vertical axial line, and having an upper end connected to an output shaft of the engine in a torque transmitting relationship;

a torque transmitting mechanism interposed between a lower end of the drive shaft and the propeller shaft; and an actuator provided in the upper case and configured to selectively turn the lower case around the first vertical axial line, the actuator including a power source and a worm gear mechanism for transmitting an output torque of the power source to the lower case, wherein the worm gear mechanism further includes an intermediate shaft rotatably supported by the upper case, a driven bevel gear attached to a first end of the intermediate shaft and a worm being attached to a second end of the intermediate shaft, and a drive bevel gear attached to an output shaft of the power source and meshing with the driven bevel gear.

19. The outboard marine motor according to claim 18, wherein the electric motor has an axial line extending in parallel with the first vertical axial line and the intermediate shaft extends substantially horizontally and at a small angle with respect to a fore-and-aft direction.

20. The outboard marine motor according to claim 18, wherein the tubular member defines a hollow interior so as to receive the drive shaft therein, the tubular member having a lower end attached to the lower case and an upper end projecting into the upper case and rotatably supported by a bearing secured to the upper case and wherein the power source is attached to the upper case for actuating the tubular member.

* * * * *